US010684073B2

(12) United States Patent
Ku

(10) Patent No.: US 10,684,073 B2
(45) Date of Patent: Jun. 16, 2020

(54) INFRARED LIGHT SOURCE DRYING APPARATUS AND DRYING METHOD

(71) Applicant: Jade Charm Industrial Limited, Shatin, New Territories (HK)

(72) Inventor: Yat Ming Ku, Shatin (HK)

(73) Assignee: JADE CHARM INDUSTRIAL LIMITED, Hong Kong (HK)

( * ) Notice: Subject to any disclaimer, the term of this patent is extended or adjusted under 35 U.S.C. 154(b) by 101 days.

(21) Appl. No.: 15/852,564

(22) Filed: Dec. 22, 2017

(65) Prior Publication Data

US 2018/0356153 A1 Dec. 13, 2018

(30) Foreign Application Priority Data

Jun. 8, 2017 (TW) ..... 106119068 A

(51) Int. Cl.

| | |
|---|---|
| ***F26B 3/34*** | (2006.01) |
| ***F26B 3/28*** | (2006.01) |
| ***F26B 9/10*** | (2006.01) |
| ***F26B 3/30*** | (2006.01) |
| ***F26B 9/00*** | (2006.01) |

(52) U.S. Cl.

CPC ..... *F26B 3/343* (2013.01); *F26B 3/283* (2013.01); *F26B 3/30* (2013.01); *F26B 9/003* (2013.01); *F26B 9/10* (2013.01)

(58) Field of Classification Search

CPC .... F26B 3/30; F26B 3/343; F26B 3/34; F26B 9/003; F26B 9/10; F26B 3/28; F26B 3/283

USPC ..... 34/269, 268, 267, 266

See application file for complete search history.

(56) References Cited

U.S. PATENT DOCUMENTS 4,979,523 A * 12/1990 Grimm ..... A45D 29/18 132/73.5
2004/0159002 A1 8/2004 Carlucci et al.
2008/0090193 A1* 4/2008 Soanes ..... F26B 3/28 432/45

(Continued)

FOREIGN PATENT DOCUMENTS

CN 2074616 U 4/1991
CN 1079129 A 12/1993

(Continued)

OTHER PUBLICATIONS

Bibliographic data for CN107257909A including English Abstract, 2 pages.

(Continued)

*Primary Examiner* — John P McCormack

(74) *Attorney, Agent, or Firm* — Ware, Fressole, Maguire & Barber LLP

(57) ABSTRACT

An infrared (IR) light source drying apparatus (10, 100, 120) is disclosed as including a body (123), an airflow output device (14, 104, 122) for outputting an airflow from the body, and an IR lamp (108, 124) for emitting an IR light ray, the apparatus being without any heating element in the path of movement of the airflow through the body. The airflow outputted by the drying apparatus (10, 100, 120) and directed towards a target (T) is at the ambient temperature, and serves to cool the target. The present invention can provide waterproof functions when drying the target, operate with batteries and use significantly less power for powering the drying apparatus.

14 Claims, 5 Drawing Sheets

(56) References Cited

U.S. PATENT DOCUMENTS

| | | | | |
|---|---|---|---|---|
| 2014/0200635 | A1* | 7/2014 | Il | A61N 5/0613 607/88 |
| 2015/0184938 | A1* | 7/2015 | Tanihara | A45D 29/00 34/245 |
| 2015/0215993 | A1* | 7/2015 | Groves | H05B 3/009 219/678 |
| 2018/0245846 | A1 | 8/2018 | Arens et al. | |

FOREIGN PATENT DOCUMENTS

| | | | |
|---|---|---|---|
| CN | 1761414 | A | 4/2006 |
| CN | 103596464 | A | 2/2014 |
| CN | 104534846 | A | 4/2015 |
| CN | 107193257 | A | 9/2017 |
| CN | 107257909 | A | 10/2017 |
| EP | 0 565 933 | A1 | 3/1993 |

OTHER PUBLICATIONS

Bibliographic Data for CN2074616U including English Abstract, 2 pages.
Bibliographic Data for CN1761414A (Conair Corporation), 2 pages.
Bibliographic Data for CN1079129A, 2 pages.
Bibliographic Data for CN104534846A1 including English Abstract, 2 pages.
Bibliographic Data for CN103596464A including English Abstract, 2 pages.
Bibliographic Data for CN107193257A including English Abstract, 2 pages.
Bibliographic Data for EP0565933A1 including English Abstract, 3 pages.
Chinese Office Action dated Mar. 30, 2020 in counterpart application 201810187993.6, including Search Report on pp. 7-9 with relevance categories indicated, 9 pages.

* cited by examiner

INFRARED LIGHT SOURCE DRYING APPARATUS AND DRYING METHOD

BACKGROUND

This invention relates to electrically operated infrared (IR) light source drying apparatus and a drying method, in particular such an apparatus which may be (though not specifically) powered by electric batteries.

The typical existing electrically powered drying apparatus with a source of airflow usually includes a heating element in the body of the drying apparatus which heats up air passing through the interior of the apparatus. The thus heated air is then outputted by the apparatus for drying a target, e.g. a hand of a user. However, as it is necessary to heat up the air in the relatively short time interval during which the air passes through the body of the apparatus, significant power has to be provided to the heating element, and thus to the drying apparatus, to raise the temperature of the air to such an extent that the air, when leaving the apparatus, is of a sufficiently high temperature for drying the target. This means that such drying apparatus can only be powered by municipal AC current, which limits the flexibility of use of such drying apparatus and hinders their portability.

SUMMARY

It is thus an object of the present invention to provide an IR light source drying apparatus and a drying method in which the aforesaid shortcomings are mitigated or at least to provide a useful alternative to the trade and public.

According to a first aspect of the present invention, there is provided an infrared (IR) light source drying apparatus including a body, an airflow output device for outputting an airflow from said body, and a heating member including an IR lamp for emitting an IR light ray, wherein said apparatus is without any heating element in the path of movement of said airflow through said body.

According to a second aspect of the present invention, there is provided a method of drying a target, including steps (a) emitting an infrared (IR) light ray to heat said target, and (b) outputting an airflow towards said target to cool said target, wherein said outputted airflow is at substantially the ambient temperature.

BRIEF DESCRIPTION OF THE DRAWINGS

Electrically powered IR light source drying apparatus and drying method according to embodiments of the present invention will now be described, by way of examples only, with reference to the accompany drawings, in which.

DETAILED DESCRIPTION

Figure 1:
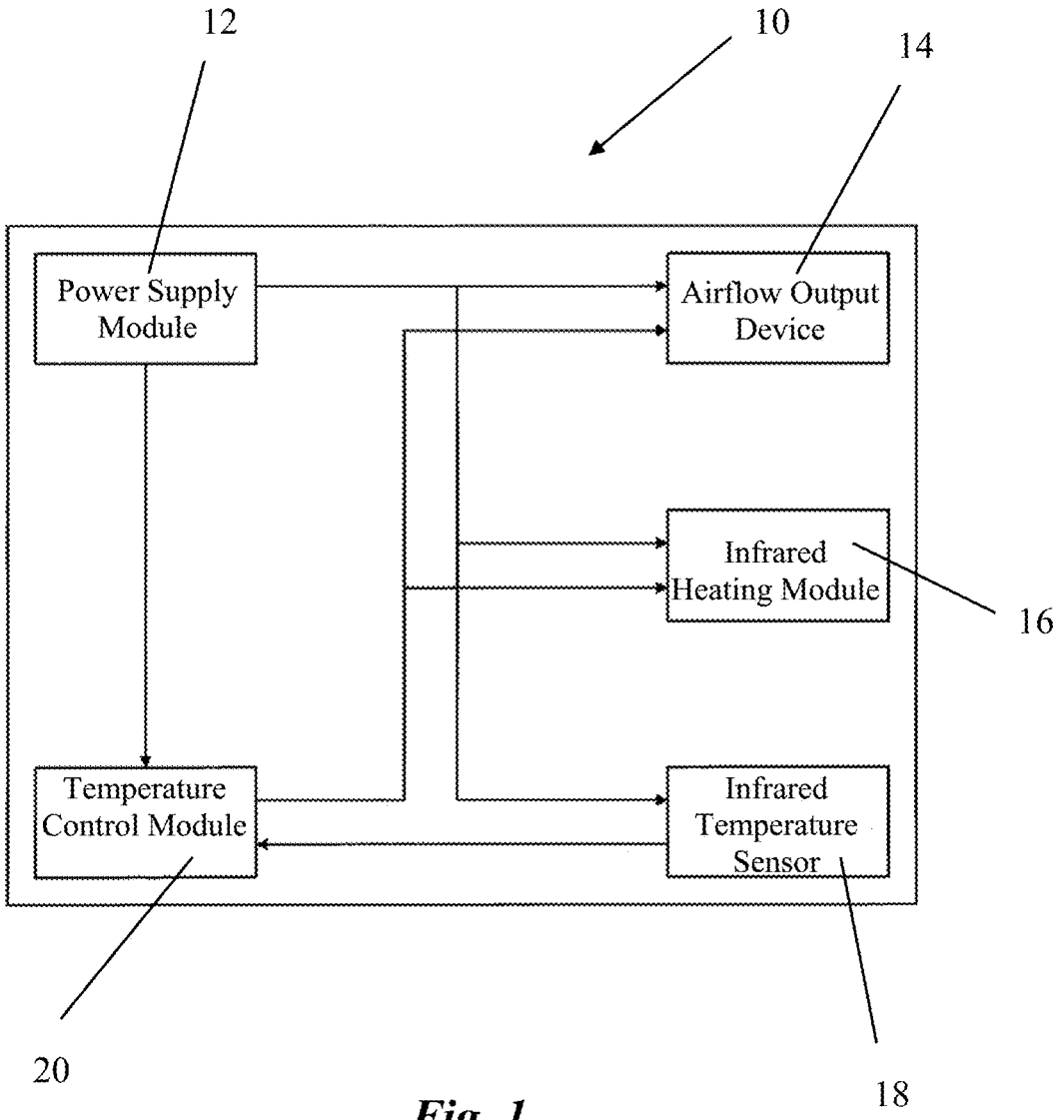
FIG. 1 is a functional block diagram of an electrically powered IR light source drying apparatus according to an embodiment of the present invention.

FIG. 1 is a functional block diagram of an electrically powered IR light source drying apparatus according to an embodiment of the present invention, generally designated as 10. The drying apparatus 10 includes:

(a) a power supply module 12, which may be a rectifier for converting AC power to DC power, or one or more electric batteries (e.g. dry batteries), for powering the electrical components of the drying apparatus 10, (b) an airflow output device 14, e.g. a fan, (c) an infrared (IR) heating module 16, including an IR lamp, (d) an IR temperature sensor 18, and (e) a temperature control module 20, such as an integrated circuit or a micro-controller unit.

The airflow output device 14, the IR heating module 16, the IR temperature sensor 18 and the temperature control module 20 are all powered by the power supply module 12. The IR temperature sensor 18 is in a data communicable relationship with the temperature control module 20. In particular, the temperature control module 20 receives temperature-related data from the IR temperature sensor 18. The temperature control module 20 is also electrically connected with the airflow output device 14 and the IR heating module 16 for controlling the operation of the airflow output device 14 and the IR heating module 16.

Figure 2:
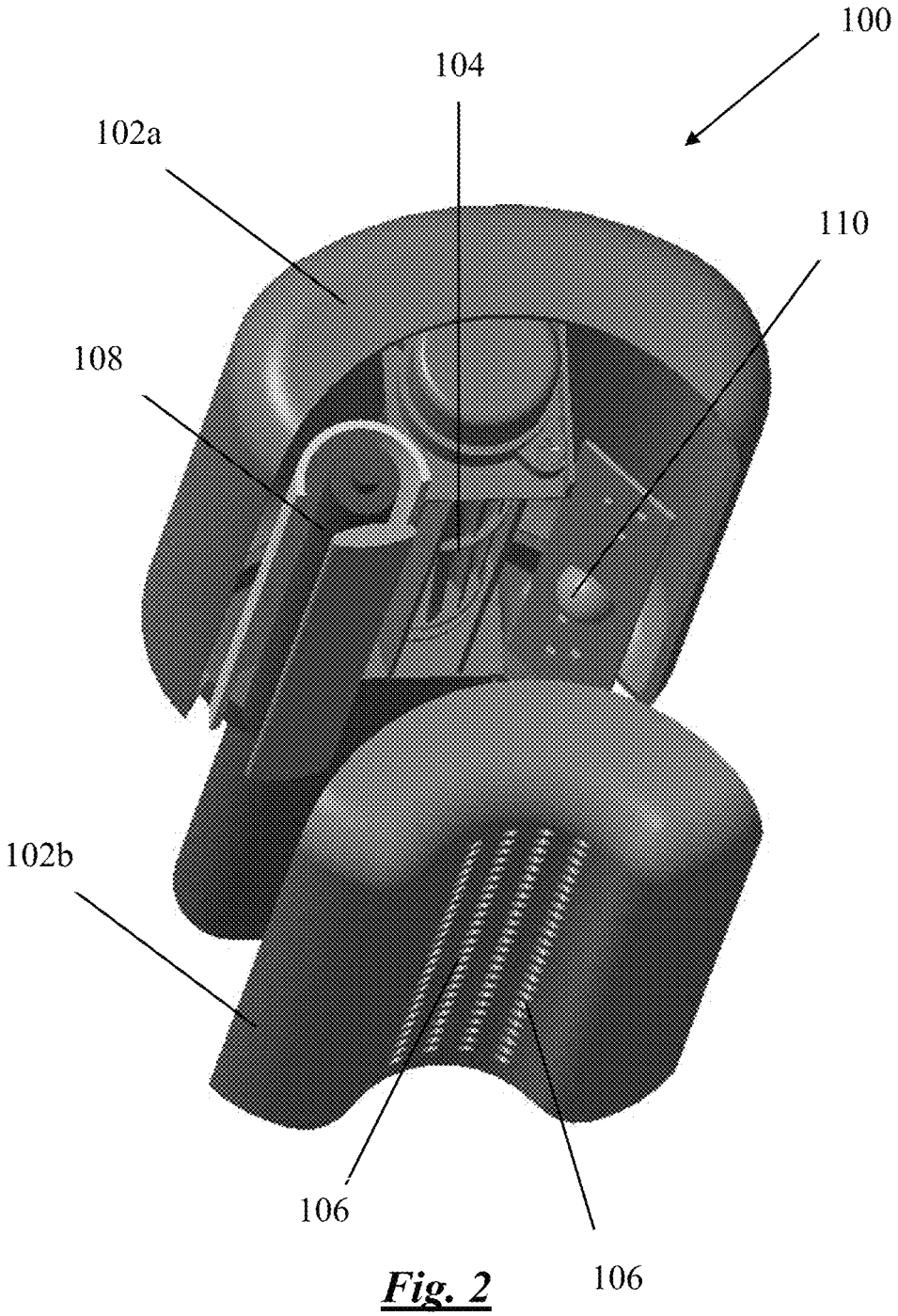
FIG. 2 is an exploded perspective view of the IR light source drying apparatus shown in FIG. 1.

Turning now to FIG. 2, such shows an exploded perspective view of an IR light source drying apparatus, generally designated as 100, which is broadly based on the arrangement shown in FIG. 1. The drying apparatus 100 has two casing halves 102*a*, 102*b* which, when assembled, collectively form a body for housing the various components of the drying apparatus 100. The drying apparatus 100 also has a fan 104 which, during operation, draws air into the body of the drying apparatus 100 and outputs the air out of the body through rows of holes 106 of the casing half 102*b*. The drying apparatus 100 includes an IR lamp 108 for heating up a target, e.g. a hand of a user, and an IR temperature sensor 110 for sensing the outside temperature, in particular the temperature of the target.

Figure 3:
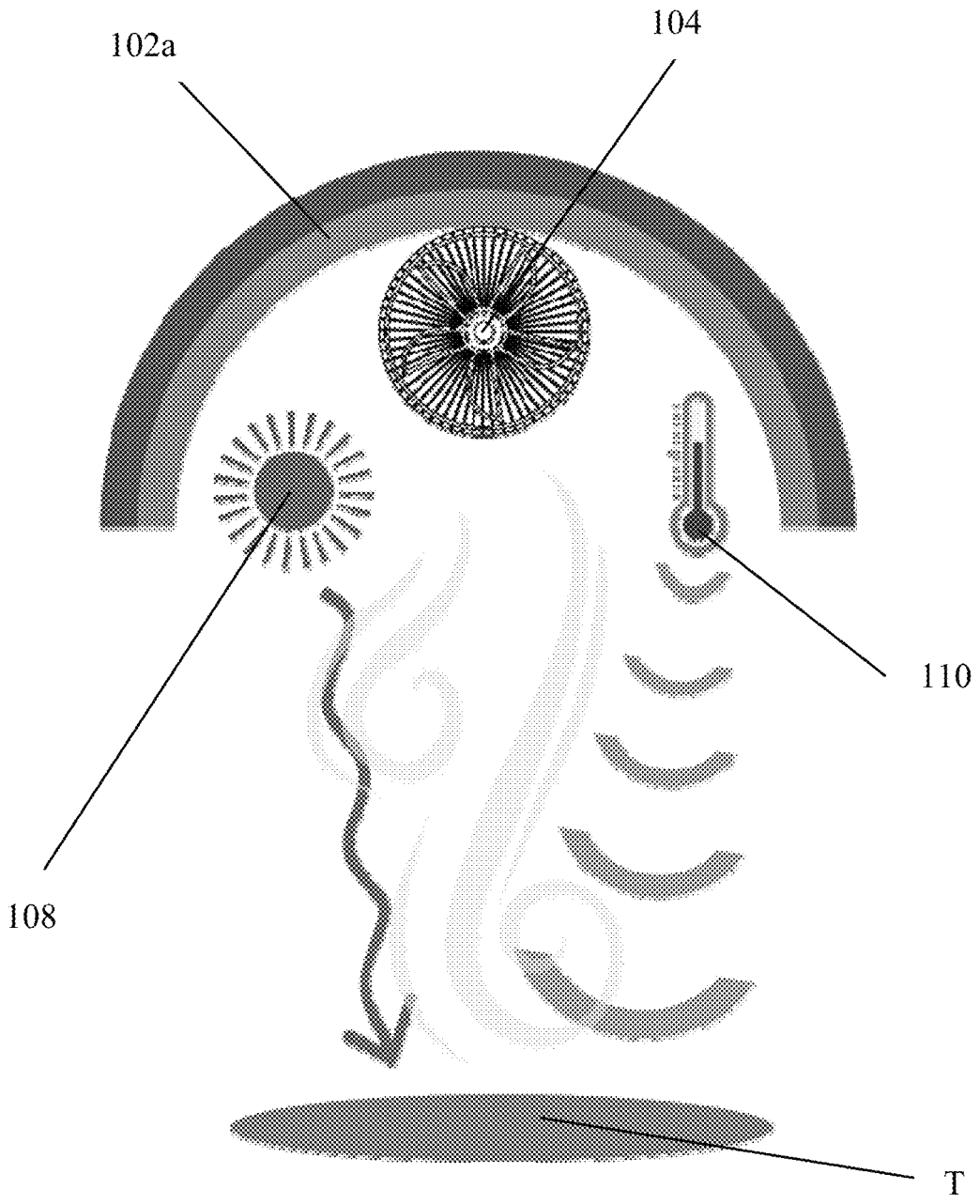
FIG. 3 is a transverse sectional view of the IR light source drying apparatus shown in FIG. 2.

As can be seen more clearly in FIG. 3, the IR lamp 108 emits IR light rays to heat up a target T to be dried by the drying apparatus 100. To blow away the air thus heated by the IR lamp 108 and to maintain the target T at an appropriate temperature, the fan 104 generates an airflow and outputs the airflow towards the area of the target T heated by the IR lamp 108. An important feature of the present invention resides in the fact that there is no heating element within the body of the drying apparatus 100. More particularly, there is no heating element in the path of movement of the airflow through the body of the drying apparatus 100. Thus, the airflow outputted by the drying apparatus 100 and directed towards the target T is at the ambient temperature, and serves to cool the target T. This is in stark contrast with the conventional drying apparatus in which airflow generated by such conventional drying apparatus is heated up, e.g. by heating filaments in the body of the apparatus, during its movement along a path in the body, for subsequent output for heating up and drying a target. As it is necessary to sufficiently heat up the airflow in the relatively short time interval during which the airflow travels along the path of movement through the body of the apparatus, significant power has to be provided to the heating element. Conventional drying apparatus cannot be waterproof due to the heating filaments assembled inside the apparatus, whereas the drying apparatus 100 according to the present invention can provide waterproof features.

The drying apparatus 100 also includes an IR temperature sensor 110 for detecting the temperature of the target T. Data relating to the detected temperature ("temperature-related data") are transmitted by the IR temperature sensor 110 to the temperature control module 20 (see FIG. 1). An upper threshold temperature value is set in the temperature control module 20, such that, if the temperature-related data transmitted by the IR temperature sensor 110 and received by the temperature control module 20 indicate that the temperature detected by the IR temperature sensor 110 is above the upper threshold temperature value, then the temperature control module 20 will increase the speed of the outputted airflow (e.g. by increasing the speed of rotation of the fan 104), or reduce the output power of the IR lamp 108, and thus the power of the IR light ray emitted by the IR lamp 108 (e.g. by reducing the power supplied to the IR lamp 108), or both. In addition, a lower threshold temperature value may also be set in the temperature control module 20, such that, if the temperature-related data transmitted by the IR temperature sensor 110 and received by the temperature control module 20 indicate that the temperature detected by the IR temperature sensor 110 is below the lower threshold temperature value, then the temperature control module 20 will reduce the speed of the outputted airflow (e.g. by reducing the speed of rotation of the fan 104), or increase the output power of the IR lamp 108, and thus the power of the IR light ray emitted by the IR lamp 108 (e.g. by increasing the power supplied to the IR lamp 108), or both.

Figure 4:
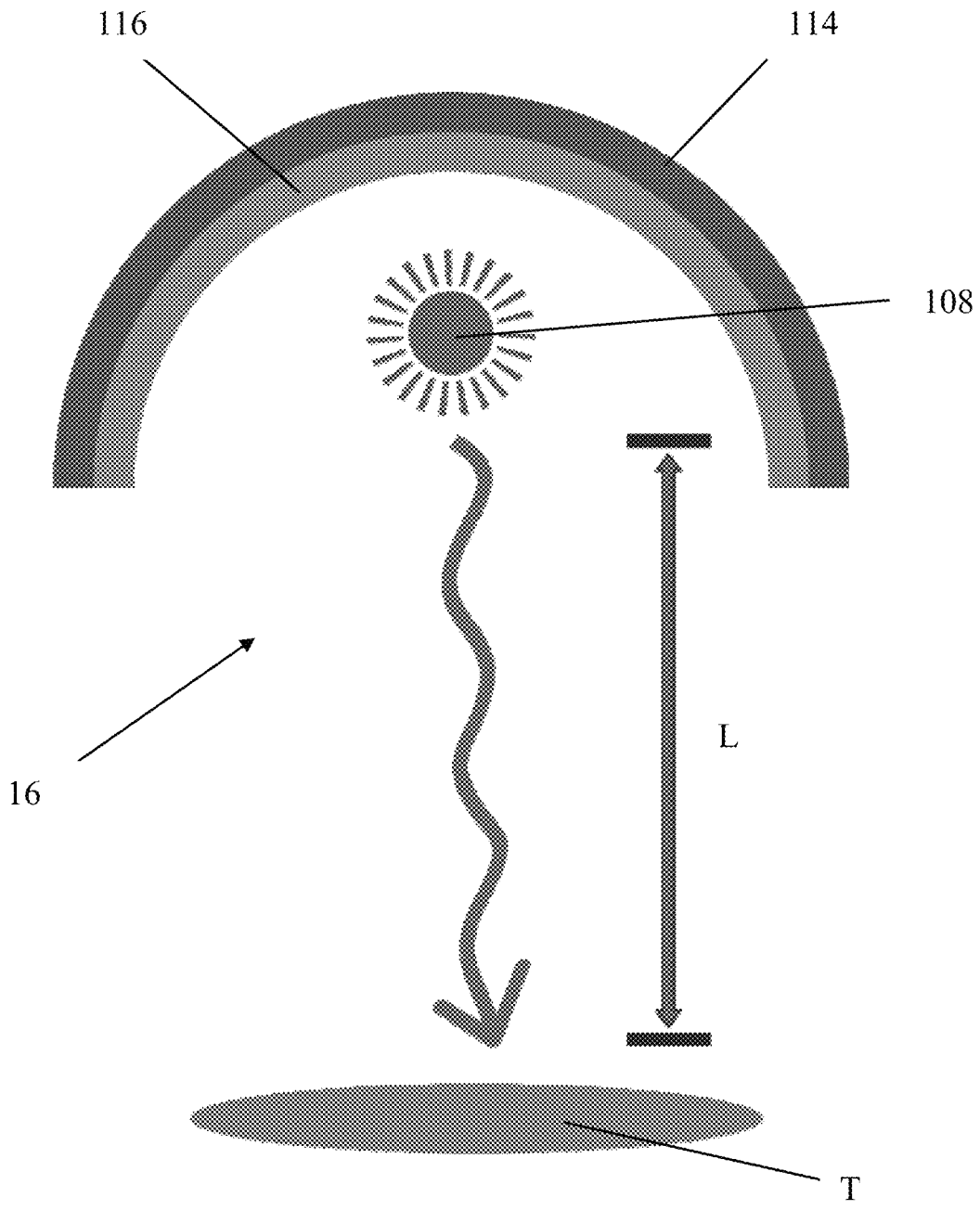
FIG. 4 is a transverse sectional view of a part of the IR light source drying apparatus shown in FIG. 2.

FIG. 4 shows in more detail the structure of the IR heating module 16. In addition to the IR lamp 108, the IR heating module 16 further includes a piece of arc- or arch-shaped IR light ray reflector 114 behind the IR lamp 108 (i.e. on the side of the IR lamp 108 facing away from the target T to be dried). The piece of arc-shaped IR light ray reflector 114 has a concave reflective surface 116 facing the IR lamp 108, to reflect IR light ray emitted by the IR lamp 108 which falls onto the reflector 114 back to the target T. The concave reflective surface 116 is coated with gold to enhance its IR reflective capability. It is possible to adjust the position of the IR lamp 108, so as to adjust the focal length L of the IR light ray emitted by the IR lamp 108 as refracted by the arc- or arch-shaped IR light ray reflector 114, to be between 0 mm and 300 mm from the IR lamp 108.

Figure 5:
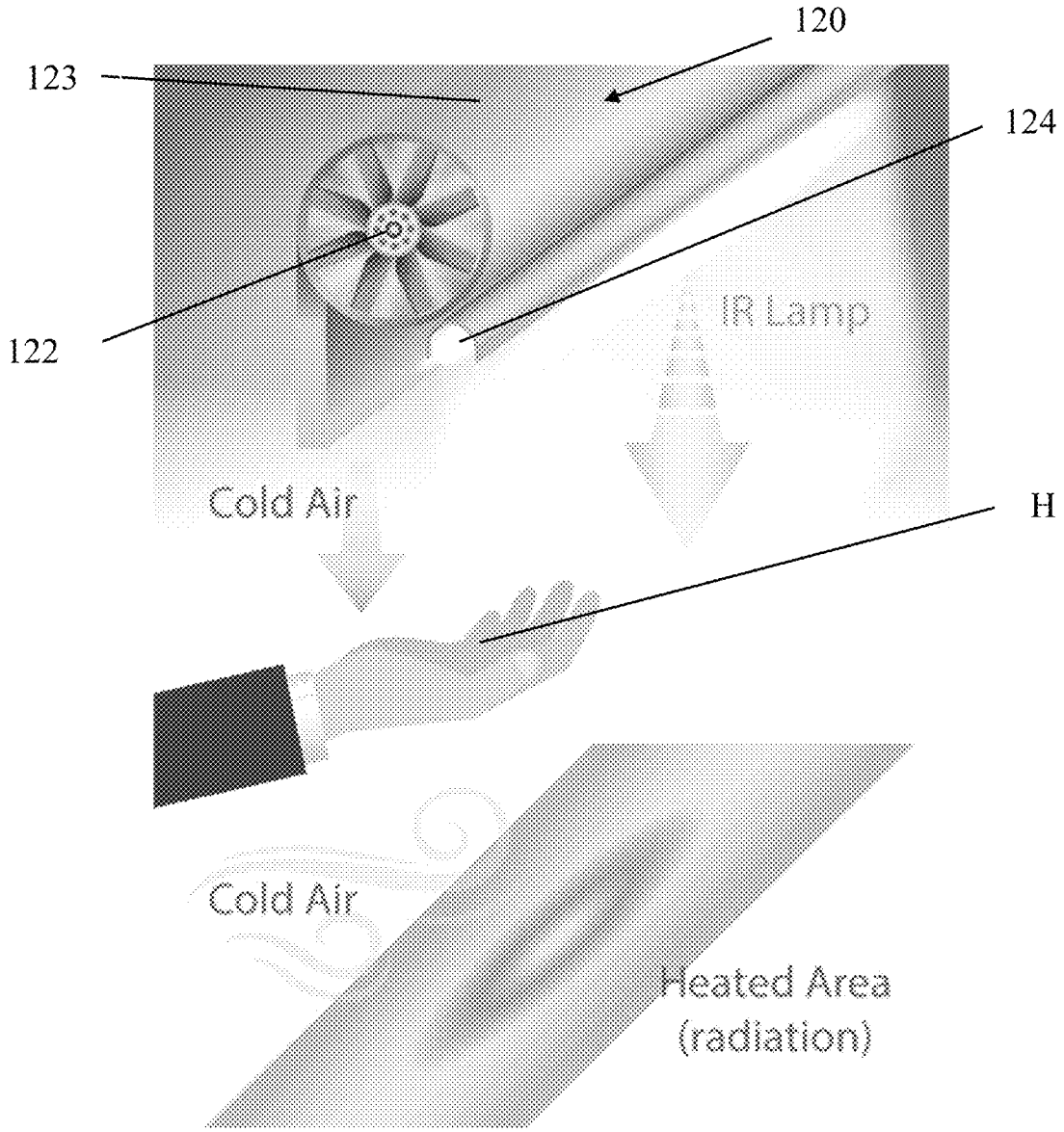
FIG. 5 shows a possible manner of use of an electrically operated IR light source drying apparatus according to another embodiment of the present invention.

FIG. 5 shows a possible embodiment of an IR light source drying apparatus according to the present invention, in the form of an electrically operated IR light source hand dryer 120, with a fan 122 within a body 123 for generating and outputting an airflow and an IR lamp 124 for heating a hand H of a user.

As only infrared (IR) heating module 16 or the IR lamp 108, 124 serve as heat source for the drying apparatus 10, 100, 120, and no heating element is provided in the path of movement of the airflow through the body of the drying apparatus 10, 100, 120, significantly less power is required for powering the drying apparatus 10, 100, 120, such that the drying apparatus 10, 100, 120 may be powered by electric batteries (e.g. dry batteries) and not municipal AC power. The flexibility and safety of use and portability of the drying apparatus 10, 100, 120 are enhanced. In addition, as there is no conventional heating element (such as heating filament) in the body of the drying apparatus 10, 100, 120 (which may short the circuit in the presence of water or moisture, thus requiring further auxiliary safety measures and arrangements), the drying apparatus 10, 100, 120 may be used close to water or moisture.

Although the present invention has thus far been discussed in the context of an electrically operated hand dryer, the present invention may be implemented in other forms of dryers, e.g. electrically operated hair dryers.

It should be understood that the above only illustrates examples whereby the present invention may be carried out, and that various modifications and/or alterations may be made thereto without departing from the spirit of the invention.

It should also be understood that certain features of the invention, which are, for clarity, described in the context of separate embodiments, may be provided in combination in a single embodiment. Conversely, various features of the invention which are, for brevity, described in the context of a single embodiment, may also be provided separately or in any appropriate sub-combinations.

The invention claimed is:

1. An infrared (IR) light source drying apparatus including:

a body, an airflow output device for outputting an airflow from said body, and a heating member including an IR lamp for emitting an IR light ray, wherein said apparatus is without any heating element in the path of movement of said airflow through said body, and wherein said IR lamp is within said body for emitting said IR light ray to radiate a target outside said body, and wherein said IR lamp is out of the path of movement of said airflow through said body.

2. The apparatus according to claim 1, wherein the focal length of the IR light ray emitted by said IR lamp is between 0 mm and 300 mm from said IR lamp.

3. The apparatus according to claim 1, wherein said IR lamp includes a reflective surface for reflecting at least a part of said IR light ray emitted by said IR lamp.

4. The apparatus according to claim 3, wherein said reflective surface of said IR lamp is coated with gold.

5. The apparatus according to claim 1, further including a temperature sensor and a temperature control module adapted to receive temperature-related data from said temperature sensor.

6. The apparatus according to claim 5, wherein said temperature sensor is an IR temperature sensor.

7. The apparatus according to claim 6, wherein said temperature control module is adapted to control the speed of said airflow outputted by an airflow output device or the output power of said IR lamp, or both, in response to said temperature-related data received from said temperature sensor.

8. The apparatus according to claim 1, wherein said apparatus is powered by at least one electric battery.

9. The apparatus of claim 1, wherein said outputted airflow is at ambient temperature and directed at a target so as to cool the target when heated by the IR light ray also directed at the target.

10. A method of drying a target, including:

(a) emitting an infrared (IR) light ray to heat said target, and (b) outputting an airflow towards said target to cool said target, wherein said outputted airflow is at the ambient temperature wherein said IR light ray is emitted from an IR lamp within a body and said target is outside said body.

11. The method according to claim 10, further including (c) reflecting at least a part of said IR light ray from a reflecting surface to heat said target.

12. The method according to claim 11, wherein a at least part of the reflective surface is coated with gold.

13. The method according to claim 10, further including (c) obtaining temperature-related data of said target.

14. The method according to claim 13, further including (d) controlling the speed of said outputted airflow, or the power of said IR light ray in response to said temperature-related data of said target, or both.

* * * * *